United States Patent [19]

Maton

[11] Patent Number: 4,579,086

[45] Date of Patent: Apr. 1, 1986

[54] VERTICAL TUBE BOILER

[76] Inventor: Maurice E. G. Maton, Christmas Cottage, Doctors Hill, Sherfield English, Romsey, Hampshire, England

[21] Appl. No.: 656,438

[22] Filed: Oct. 1, 1984

[51] Int. Cl.[4] ..... F22B 5/00

[52] U.S. Cl. ..... 122/17; 122/115

[58] Field of Search ..... 122/16, 17, 18, 122, 122/115; 126/391

[56] References Cited

U.S. PATENT DOCUMENTS 1,707,812 4/1929 Lynch ..... 122/115 X 2,573,551 10/1951 Denker et al. ..... 122/122

*Primary Examiner*—Edward G. Favors

*Attorney, Agent, or Firm*—Maky, Renner, Otto & Boisselle

[57] ABSTRACT

A vertical tube boiler having a plurality of vertical tubes which extend through a water tank and communicate with a combustion chamber and a chamber provided with a flue outlet, the tank being provided with a transverse plate located above the bottom or firing plate of the tank and provided with holes 20 through which the tubes extend with a clearance gap being provided between the periphery of each hole 20 and the outside of the associated tube, through which gaps water flows upwardly to create upward currents in the water within the tank to hold any scale removed from the outside of the tubes in suspension and if such scale drops to the bottom of the tank, then it accumulates on the plate and not on the firing plate thus preventing burning out of the firing plate.

4 Claims, 4 Drawing Figures

VERTICAL TUBE BOILER

SUMMARY OF THE INVENTION

This invention relates to a vertical tube boiler.

Vertical tube boilers have a plurality of vertical tubes which extend from a combustion chamber, through the water tank and terminate in an upper chamber to which the exhaust flue is connected. A disadvantage of known boilers of this type is that any scale which is removed from the outside of the vertical tubes falls onto the upper side of the firing plate which defines the upper wall of the combustion chamber and the lower wall of the water tank and this causes the firing plate to become overheated at localised regions and the firing plate burns out and has to be replaced which is an expensive operation.

According to the present invention there is provided a vertical tube boiler comprising a plurality of vertical tubes which extend from a combustion chamber, through a water tank to an upper chamber provided with a flue outlet, a secondary plate being provided in the tank above and vertically spaced from a firing plate which forms the bottom wall of the tank and the upper wall of the combustion chamber, said tubes extending through holes provided in said secondary plate with a gap being formed between the outside surfaces of the tubes and the periphery of the holes in said secondary plate, means for supplying water into the space formed between the secondary plate and the firing plate, said water being caused to flow upwardly through said gaps.

The upward flow of water through said gaps creates an upward current to cause any scale removed from the tubes to be held in suspension in the water. If any removed scale does descend to the bottom of the tank then it collects on the secondary plate and not on the firing plate.

BRIEF DESCRIPTION OF THE DRAWINGS

To the accomplishment of the foregoing and related ends, the invention then comprises the features hereinafter fully described and particularly pointed out in the claims, the following description and annexed drawings setting forth in detail an illustrative embodiment of the invention, this being indicative however of only one way in which the principle of the invention may be employed.

In said annexed drawings.

DESCRIPTION OF THE PREFERRED EMBODIMENT

Figure 1:
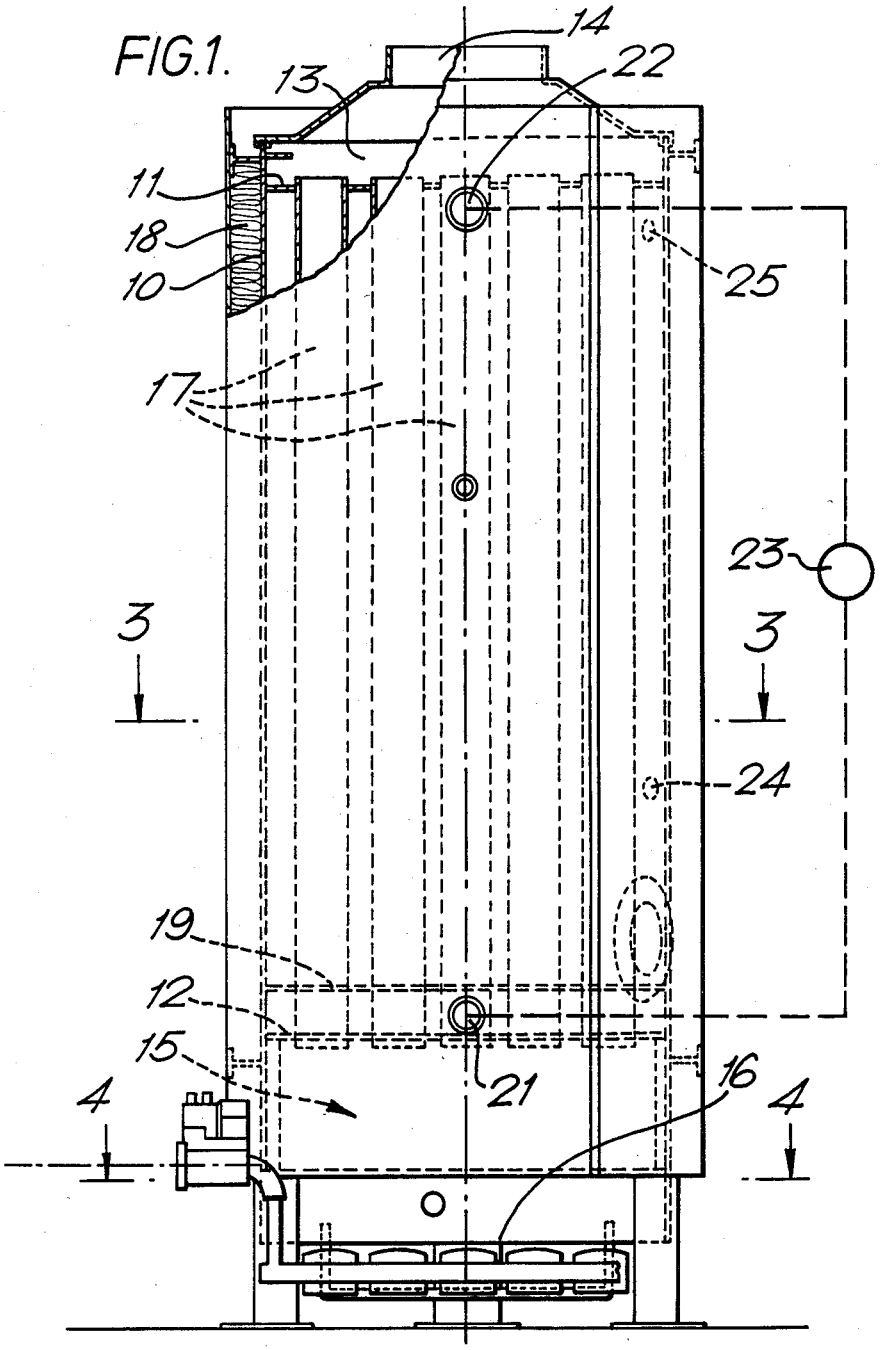
FIG. 1 is a longitudinal section through a vertical tube boiler according to the present invention.
Figure 2:
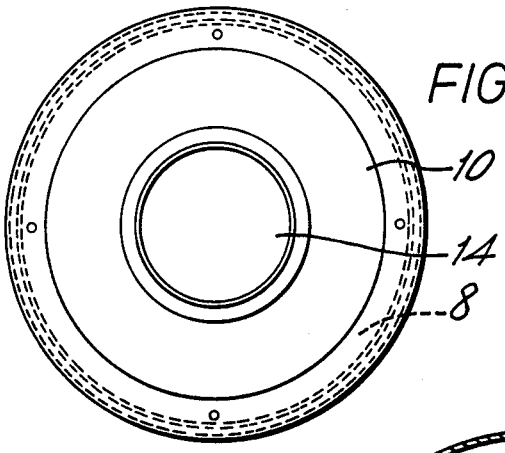
FIG. 2 is a plan view of the boiler.
Figure 3:
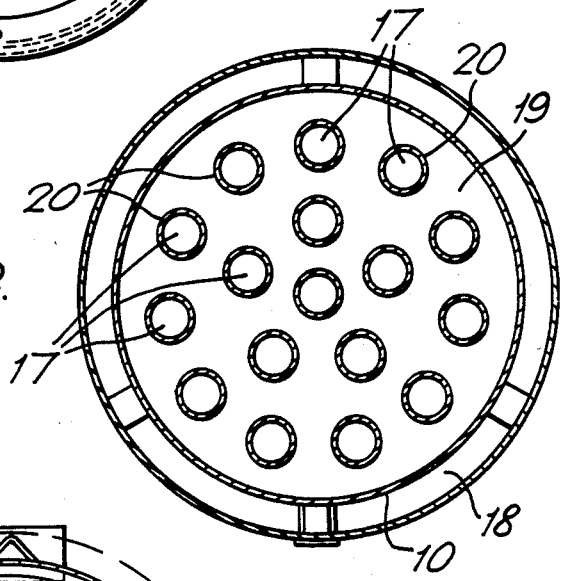
FIG. 3 is a cross-section through the boiler taken along the line 3—3 indicated in FIG. 1.
Figure 4:
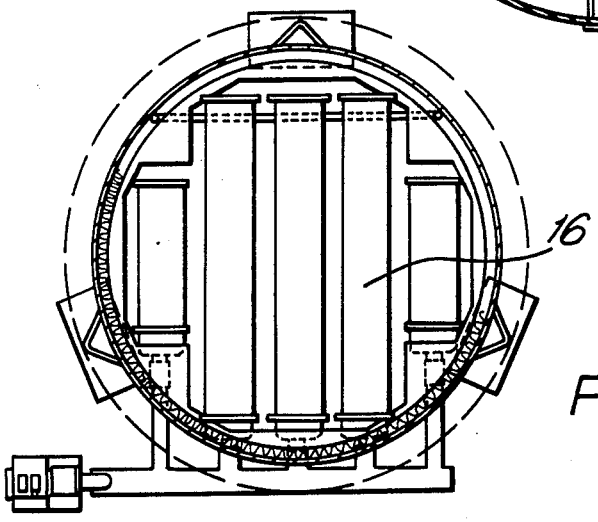
FIG. 4 is a cross-section taken along the line 4—4 indicated in FIG. 1.

The vertical tube boiler comprises water tank 10 having an upper wall 11 and a bottom wall 12 usually referred to as the firing plate. Located above the upper wall 11 is an upper chamber 13 provided with a flue outlet 14. Located beneath the firing plate 12 is a combustion chamber 15. The combustion chamber 15 is provided with fuel burners 16. Extending between the chambers 13 and 15 are a plurality of vertical tubes 17 through which the hot combustion gases flow. Each tube 17 may contain turbulator means which cause the gases to scrub against the inner surface of the tube 17. The tank 10 is surrounded by heat insulating means 18.

Located within the tank 10 is a secondary transverse plate 19 provided with a plurality of holes 20 through which the tubes 17 extend with a clearance gap between the periphery of each hole 20 and the outside of the associated tube 17. An inlet conduit 21 is connected to the tank 10 in the region between the plate 19 and the plate 12. An outlet conduit 22 is connected to the upper end region of the tank 10. A circulating pump 23 is provided in the flow circuit between the conduits 21 and 22. The pump 23 may be an existing circulating pump or a secondary pump. The gas between the peripheries of the holes 20 and the tubes 17 may be approximately 5 millimeters.

In use of the boiler the water which flows through the inlet conduit 21 creates an upward flow through the gaps surrounding the tubes 17 and this flow creates upward currents which hold any scale removed from the outside of the tubes 17 in suspension in the water. If any scale drops to the bottom of the tank 10 then it accumulates on the secondary plate 19 and does not contact the firing plate 12.

With such an arrangement there is little or no temperature stratification within the water contained in the tank 10 and therefore a temperature sensing control device 24 can be located at any desired position. An over temperature control 25 is provided at the upper end of the tank 10. The pressure within the chamber formed between the plate 12 and plate 19 is that produced by the head of water plus the circulating pressure produced by the pump 23.

Even when the boiler is inoperative the pump 23 continues to operate and thus there is always a flow through the gaps surrounding the tubes 17.

I, therefore particularly point out and distinctly claim as my invention:

1. A vertical tube boiler comprising a water tank having an upper wall and a bottom wall, an upper chamber formed above said upper wall and having a flue outlet, a combustion chamber formed beneath said bottom wall, said bottom wall forming the upper wall of said combustion chamber and constituting a firing plate, a secondary plate located in said tank above and vertically spaced from said firing plate, a plurality of vertical tubes, each of said tubes extending from said combustion chamber through said tank to said upper chamber, said tubes extending through holes provided in said secondary plate with a gap being formed between the outside surfaces of said tubes and the periphery of said holes in said secondary plate, and means for supplying water into the space formed between said secondary plate and said firing plate, said water thereby being caused to flow upwardly through said gaps.

2. A vertical tube boiler as claimed in claim 1, in which each tube contains means for causing gases flowing along the tube to scrub against the inner surface of the tube.

3. A vertical tube boiler as claimed in claim 1, in which the tank is surrounded by heat insulating material.

4. A vertical tube boiler as claimed in claim 1, including a pump for circulating water between the means for supplying water and an outlet provided in the upper end region of the tank.

* * * * *